US005540207A

United States Patent [19]

Absenger

[11] Patent Number: 5,540,207

[45] Date of Patent: Jul. 30, 1996

[54] CAMSHAFT DRIVE

[76] Inventor: Erich Absenger, Gottweigerstrasse 39, Passau, Germany, D-94032

[21] Appl. No.: 351,332

[22] PCT Filed: Apr. 8, 1994

[86] PCT No.: PCT/EP94/01097

§ 371 Date: Feb. 16, 1995

§ 102(e) Date: Feb. 16, 1995

[87] PCT Pub. No.: WO94/24419

PCT Pub. Date: Oct. 27, 1994

[30] Foreign Application Priority Data

Apr. 10, 1993 [DE] Germany ..... 43 11 877.1

[51] Int. Cl.[6] ..... F01L 1/12; F01L 1/18

[52] U.S. Cl. ..... 123/508

[58] Field of Search ..... 123/508

[56] References Cited

U.S. PATENT DOCUMENTS

| | | | |
|---|---|---|---|
| 3,814,067 | 6/1974 | De La Fuente | 123/508 |
| 3,908,613 | 9/1975 | Loby | 123/508 |
| 4,412,513 | 11/1983 | Obermayer et al. | 123/508 |
| 4,602,604 | 7/1986 | Kauer | 123/508 |
| 5,390,642 | 2/1995 | Thoma | 123/508 |

FOREIGN PATENT DOCUMENTS

| | | |
|---|---|---|
| 1563362 | 4/1969 | France . |
| 662172 | 12/1951 | United Kingdom . |

*Primary Examiner*—Thomas N. Moulis

[57] ABSTRACT

Described is a camshaft drive for the outlet and inlet valves and for actuating the fuel-injection pump (6) of a diesel engine, the invention calling for the three actuation functions to be carried out by the same cam (2) indirectly via a rocker arm (3, 5) for each cylinder.

3 Claims, 3 Drawing Sheets

CAMSHAFT DRIVE

Figure 1:
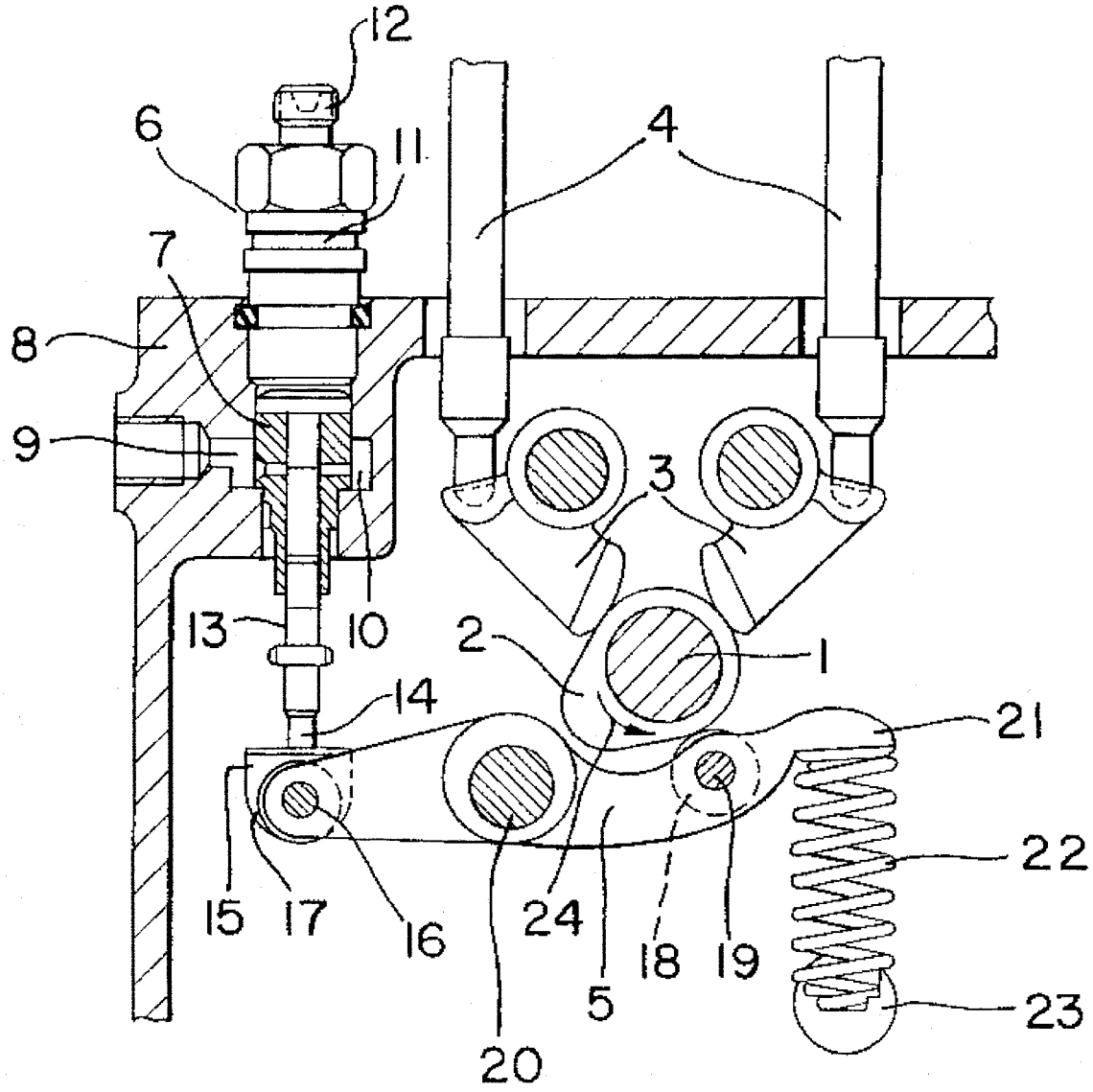

The invention relates to a camshaft drive over a camshaft for the exhaust valve and the inlet valve and for actuating the injection pump of a diesel engine, only one cam being provided for actuating the three functions of each cylinder. Shortening the camshaft, particularly of small diesel engines, is an objective aimed for by the designer. He will therefore attempt to reduce the number of cams for the drives that are to be actuated over the camshaft. In this connection, the different requirements of the courses of motion, on the one hand, for the two valves and, on the other, for the injection pump, are a problem. The valve timing aims at keeping the inlet valve, when it reaches the top dead center, and the outlet valve, when it reaches the bottom dead center, open for a sufficiently long time, so that good filling and emptying of the cylinder can be achieved. Accordingly, the designer aims for a more elongated, ideally rectangular course for the curve between the top dead center and the bottom dead center. The mass accelerations of the valve drive and the Hertz forces can be limited by a curve approximating such a rectangular profile.

On the other hand, the requirements for the driving mechanism of the injection pump are such as to make the actual injection time as short as possible. The ideal curve for the plunger velocity, related to the cam angle, is a curve for the velocity of the plunger of the injection pump that rises particularly steeply up to the top dead center; in this connection, the three phases of the pump control, namely the preliminary stroke, during which the intake port is closed, an intermediate stroke, during which the retraction volume in the injection pump is filled and, finally, the injection stroke, which is terminated shortly before the top dead center of the pump plunger is reached, are connected timewise within this rising branch of the velocity curve. On the other hand, if anything, the decreasing branch of the velocity profile must be described as noncritical.

Starting out from these different requirements for the timing of the two valves on the one hand and of the injection pump on the other, the designer previously has been forced to provide separate camshaft drives, for example, in the form of a camshaft with two cams, namely one for actuating the drag lever for the inlet valve and the exhaust valve and a further one for actuating the injection pump, in order to realize the two functions.

Moreover, a cam drive for the three functions, but with only one cam is known (DE-A1-3325510), this function meaning the actuation of the injection pump as well as of the inlet valve and the exhaust valve. However, the requirements, which are explained above and must be met by the different courses of motion, cannot be fulfilled with the known cam drive.

With the above as a background, it is an object of the present invention to provide a simple, multifunctional camshaft drive, which requires reduced constructive effort and enables a compact construction, so that it does justice to the requirements of very small diesel units in a special manner.

Pursuant to the invention, this objective is accomplished owing to the fact that the actuation through the cam takes place in each case directly over a rocker arm and that, for controlling the plunger velocity of the injection pump, the mechanical advantage with respect to the swiveling axis of the rocker arm and its distance from the connecting line between the rolling-off point of the rocker arm with the cam and the rolling-off point of the rocker arm with the plunger is selected so that, for a pump stroke of at most 10 mm, the velocity profile for the plunger velocity, based on the cam angle, increases more steeply than that for the two valves. By these means, not only is an extremely small structural volume achieved for the whole of the camshaft drive, including disposing the injection pump, but also, aside from the three functions mentioned, further engine functions, such as a lubricating oil pump and/or a fuel supply pump can be actuated over the rocker arm for the injection pump.

Within the scope of the invention, the construction of the rocker arm is of special importance for the actuation of the injection pump. The rocker arms for actuating the exhaust valve and the inlet valve can usually be constructed as drag levers. On the other hand, the rocker arm for the injection pump is constructed so as to realize the steep velocity profile for the plunger velocity by the configuration and arrangement of the rocker arm. For this purpose, the inventive starting point is the consideration that, aside from the mechanical advantage with respect to the swiveling axis of the rocker arm, the spatial arrangement of the swiveling axis of the rocker arm has a decisive effect on the course of the plunger velocity in such a way, that the course of the plunger velocity, relative to the cam angle, is steeper when the distance between the swiveling axis of the rocker arm and the line connecting the two rolling-off points of the rocker arm is less; this distance can even assume a negative value, that is, the swiveling axis of the rocker arm migrates over said connecting line, to that side of the connecting line, on which the camshaft is also located. In practice, it has proven to be advisable to select a distance between the center point of the swiveling axis of the rocker arm and the line connecting the rolling-off point with the cam and the rolling-off point with the plunger, which is less than 40% of the length of this connecting line and preferably is between 5% and 15% of the length of this connecting line. In a particularly preferred embodiment, the rocker arm assumes an approximately linear, elongated shape, that is, the swiveling axis of the rocker arm is offset laterally by less than 10%, relative to the length of the line connecting the rolling-off points of the rocker arm on the cam side and on the plunger side. In this manner, a high relative velocity is ensured between the rotating cam and the assigned rolling-off point. Geometrically, this means that the circular path of the rolling-off point encloses a relatively large angle with the direction of action specified by the cam rotation or, in other words, that the rolling-off point runs, so to say, towards the cam, with the result that the relative velocity and, with that, correspondingly the velocity of the pump plunger increase in the rolling-off point.

In contrast, it would be inadequate for the actuation of the pump merely to increase the mechanical advantage of the rocker arm over that of conventional rocker arms. Admittedly, higher driving velocities could be achieved in this manner; at the same time, however, the lengthening of the rocker arm, which is located on the pump side, would mean a corresponding increase in the pump stroke, since the injection pump cannot be positioned optionally close to the camshaft. However, only injection pumps with a relatively small pump stroke, limited to about 10 mm, are obtainable on the market. The path for using a single cam to actuate the valves as well as the injection pump was cleared only by the "rocker arm elongated" in the sense of the inventive proposal.

The return spring for the rocker arm, which actuates the injection pump, can be formed either by the plunger spring in the injection pump or by a separate compression spring, which is fastened to an extension of the cam-side end of the rocker arm or also by an appropriately positioned tension spring, so that a constant contact with the cam is ensured.

The two valves are supported in the usual manner by valve springs. For the case that the plunger spring in the injection pump has been omitted, because it is replaced by an external compression or tension spring engaging the rocker arm, it is necessary to guide the rolling-off point of the rocker arm at the foot end of the plunger by means of a catch in constant contact with the plunger foot.

Figure 2:
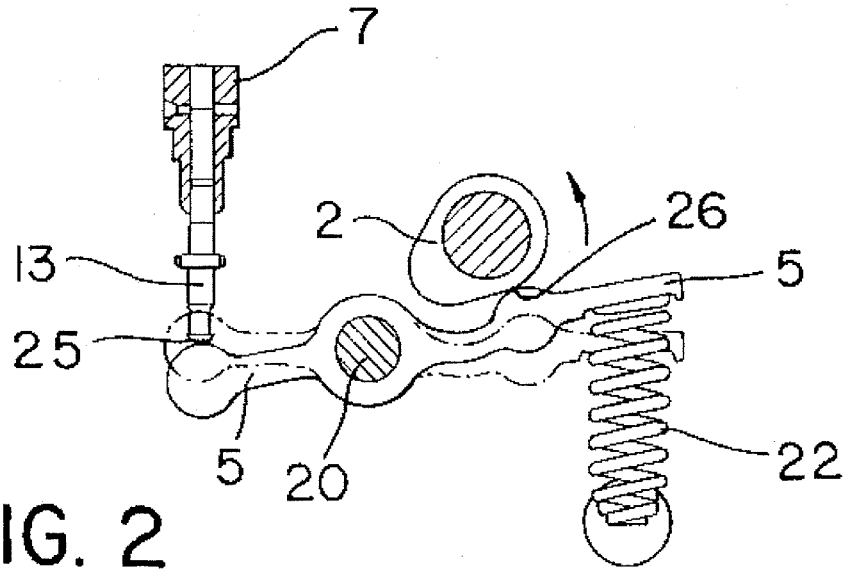
Figure 3:
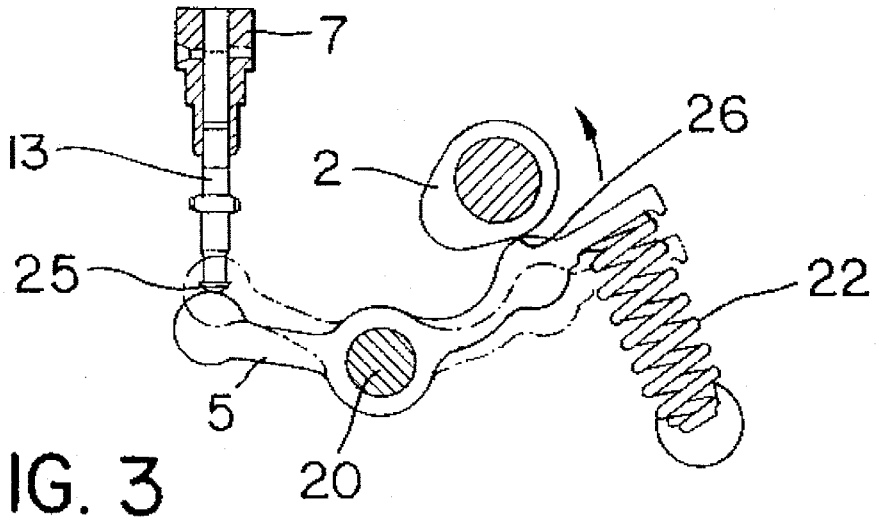
Figure 4:
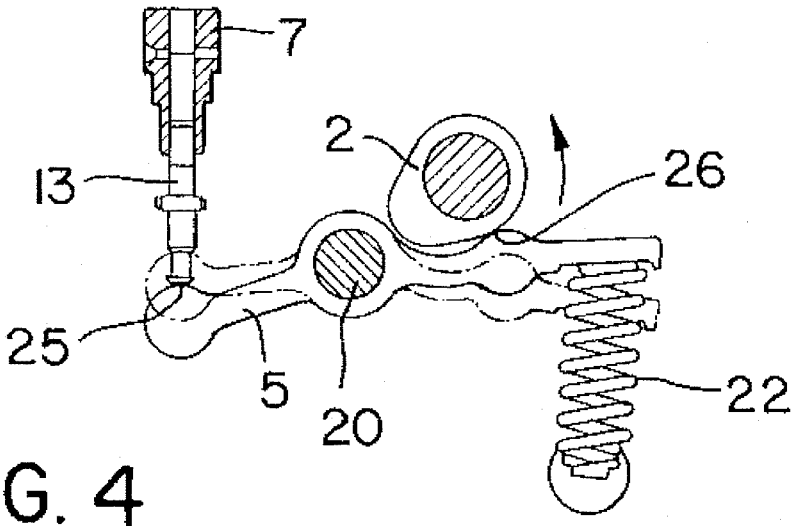
Figure 5:
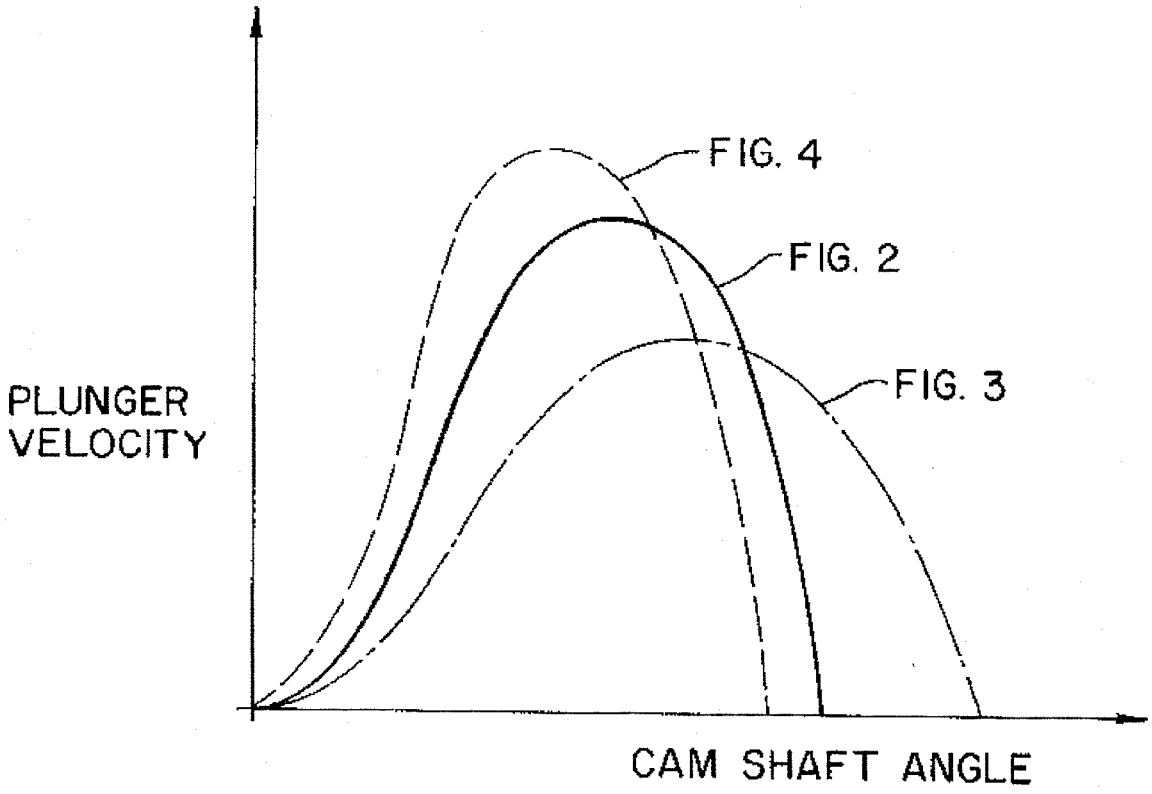

In the following, an embodiment of the invention is explained by means of the drawing, in which FIG. 1 shows a cross section through a 3-function camshaft FIG. 2 shows an elongated rocker arm for driving the injection pump FIG. 3 shows a rocker arm, which is bent to the outside, for driving the injection pump FIG. 4 shows a rocker arm, which is bent to the inside, for driving the injection pump FIG. 5 shows curves for the rocker arm shapes of FIGS. 2 to 4.

FIG. 1 shows a cross section through a camshaft 1 with a single cam 2, on the one hand, for actuating the drag lever 3, with which the valve tappets 4 for the inlet valve and the exhaust valve are controlled and, on the other hand, for actuating a rocker arm 5, with which the injection pump 6 is controlled. This injection pump 6 is seated with its pump cylinder 7 directly in a corresponding borehole of the cylinder head 8, in which the appropriate ducts for the flow of fuel have also been incorporated, namely a duct 9 for the supply of fuel and a duct 10 for the return of fuel. A connecting thread 12 is provided at the upper end of the pump head 11 for connecting the pressure line. The rocker arm end 14 of the pump plunger 13 is connected over a catch 15 with a scanning roller 17 mounted on the shaft 16. A further scanning roller 18, which can be rotated about a bolt 19 mounted in the rocker arm, acts together with the cam 2. The rocker arm 5 for actuating the injection pump 13 can be swiveled about a swiveling axis 20 of the rocker arm. Contact between the scanning roller 18 and the cam 2 of the camshaft 1 is assured by a compression spring 22, which is attached to an elongated end 21 of the rocker arm 5 and is mounted between the end 21 of the rocker arm 5 and a seat 23 fastened to the housing. Corresponding to the rotation of the camshaft in the direction of the arrow 24, three functions are serviced consecutively by the same cam 2, namely the rocker arm 5 for actuating the injection pump and the two drag levers 3 for actuating the valve tappets 4 for the inlet valve and the exhaust valve. When the pump plunger 13 is actuated, the conventional functions, associated with injecting fuel, are controlled over a control curve, details of which are not shown and which is located at the inner end of the pump plunger 13.

Differently constructed rocker arms 5 for actuating the pump are compared in FIGS. 2 to 4. In contrast to the more or less elongated rocker arm of FIG. 2, the rocker arm of FIG. 3 is bent towards the outside, that is, the swiveling axis 20 of the rocker arm is, with respect to the drawing, below the line connecting the two rolling-off points 25, 26 at the rocker arm 5; on the other hand, the rocker arm of FIG. 4 is angled more towards the inside, that is, the swiveling axis 20 of the rocker arm is, with respect to the drawing, above said connecting line. If these relationships, oriented towards the optical appearance, are related to the geometric center of the above three embodiments of the rocker arm, the centers lie approximately on or below the connecting line (FIG. 4), the distances from the line connecting the two rolling-off points 25, 26 amounting to approximately 10% (FIG. 2) or approximately 30% (FIG. 3) of the length of the line. Accordingly, in FIG. 4, the swiveling axis 20 of the rocker arm is offset furthest to the inside (or the top), with the result that the relative velocity in the associated rolling-off point 26, caused by the rotation of the cam 2, is clearly greater than that in FIGS. 2 and 3. Numerous intermediate positions between the angled rocker arm shape and its elongated form are conceivable; the suitable shape of the rocker arm 5 will be selected by the expert in adaptation to the desired course of plunger velocity, for example, between the two extreme curves shown in FIG. 5. In FIG. 5, the curve with the continuous line shows the profile of the plunger velocity with an elongated rocker arm of FIG. 2; the curve, consisting of a line of dots and dashes, shows the profile of the plunger velocity with a rocker arm of FIG. 3, which is bent to the outside. The curve with the line of dashes shows the profile of the plunger velocity with a rocker arm of FIG. 4, which is bent slightly towards the inside. Numerous variations between the two extreme curves, with different steepnesses of the rising branch of the course of the plunger velocity over the cam angle, critical for the injection time, are conceivable. The curves illustrate the effect of the shape of the rocker arm or of the position selected for the swiveling axis of the rocker arm on the course of the velocity. In FIGS. 2 to 4, the rocker arm 5 is shown with a continuous line in each case in the position of contact with the cam 2; the position of the rocker arm, shown by the line of dots and dashes, in each case shows the maximum deflection of the rocker arm by the cams 2, the pump plunger 13 always being in the maximum retracted position. It is readily understandable to those skilled in the art that the presentations of FIG. 5 merely relate to different positions of the swiveling axis 20 of the rocker arm, the spatial position of the injection pump 13, on the one hand, and the camshaft 1, on the other, being unchanged. At the same time, the lever lengths, between the swiveling axis 20 of the rocker arm and the two rolling-off points 25, 26, related to the center of the swiveling axis 20 of the rocker arm, are selected to be identical; it is readily conceivable that curves approximately parallel to those drawn can be achieved by a lever of different mechanical advantage.

I claim:

1. A camshaft drive over a camshaft for the exhaust valve and the inlet valve and for actuating the injection pump (6) of a diesel engine, only one cam (2) being provided for actuating the three functions of each cylinder, characterized in that the actuation through the cams (2) in each case takes place directly over a rocker arm (3, 5) and in that, for controlling the plunger velocity of the injection pump (6), the mechanical advantage with respect to the swiveling axis (20) of the rocker arm and its distance from the connecting line between the rolling-off point (26) of the rocker arm (5) with the cam (2) and the rolling-off point (25) of the rocker arm (5) with the plunger (13) is selected so that, for a pump stroke of at most 10 mm, the velocity profile for the plunger velocity, based on the cam angle, increases more steeply than that for the two valves.

2. The camshaft drive of claim 1, characterized in that the distance is less than 40% of the length of the connecting line and preferably is between 5% and 15%.

3. The camshaft drive of claim 2, characterized in that the rocker arm (5) is constructed so as to be elongated approximately linearly.

* * * * *

UNITED STATES PATENT AND TRADEMARK OFFICE

CERTIFICATE OF CORRECTION

PATENT NO. : 5,540,207

DATED : July 30, 1996

INVENTOR(S) : Erich ABSENGER

It is certified that error appears in the above-identified patent and that said Letters Patent is hereby corrected as shown below:

On the title page, item (73), Insert

Assignee: Motorenfabrik Hatz GmbH & Co. KG,
Ruhstorf/Rott, Germany

Signed and Sealed this

Seventh Day of April, 1998

Bruce Lehman

*Attest:*

BRUCE LEHMAN

*Attesting Officer*

*Commissioner of Patents and Trademarks*